US009976347B2

(12) United States Patent
Viljanen et al.

(10) Patent No.: US 9,976,347 B2
(45) Date of Patent: May 22, 2018

(54) PIT LADDER WITH SAFETY DEVICE

(71) Applicant: KONE CORPORATION, Helsinki (FI)

(72) Inventors: Mikko Viljanen, Espoo (FI); Mika Alvesalo, Espoo (FI); Tapio Siironen, Vantaa (FI)

(73) Assignee: KONE CORPORATION, Helsinki (FI)

( * ) Notice: Subject to any disclaimer, the term of this patent is extended or adjusted under 35 U.S.C. 154(b) by 0 days. days.

(21) Appl. No.: 15/197,035

(22) Filed: Jun. 29, 2016

(65) Prior Publication Data

US 2017/0044830 A1 Feb. 16, 2017

(30) Foreign Application Priority Data

Aug. 12, 2015 (EP) ..... 15180734

(51) Int. Cl.
*E06C 7/14* (2006.01)
*E06C 7/48* (2006.01)

(52) U.S. Cl.
CPC ..... *E06C 7/48* (2013.01)

(58) Field of Classification Search
CPC ... E06C 7/486; E06C 7/48; E06C 7/16; E06C 7/165
USPC ..... 248/110, 111, 210, 211; 182/115, 116, 182/194, 206
See application file for complete search history.

(56) References Cited

U.S. PATENT DOCUMENTS 3,853,202 A * 12/1974 Jarboe ..... E06C 7/486 182/108

FOREIGN PATENT DOCUMENTS

| | | | |
|---|---|---|---|
| EP | 1 609 943 A1 | | 12/2005 |
| JP | 2013-213407 A | | 10/2013 |
| JP | 2013213407 A | * | 10/2013 |
| JP | 2014-34795 A | | 2/2014 |

* cited by examiner

*Primary Examiner* — Todd M Epps
(74) *Attorney, Agent, or Firm* — Birch, Stewart, Kolasch & Birch, LLP

(57) ABSTRACT

A ladder support bracket has a support shoulder for creating a support contact with a complementary backup. The bracket includes at least one jaw for joining the bracket to an upstanding rail of a ladder, the jaw having also a retainer mechanism by means of which the bracket—when being attached to a rail of a ladder—can be brought into a clamping position attaching the bracket unmovably to the rail and a release position holding the bracket in a swivel connection relative to the rail and/or movably along at least a section of such rail.

18 Claims, 4 Drawing Sheets

PIT LADDER WITH SAFETY DEVICE

FIELD OF THE INVENTION

The present invention relates to a ladder and especially to a safety device for it enabling a safe positioning against an object like a pit wall when for example being propped up in an elevator shaft.

BACKGROUND OF THE INVENTION

It is a matter of regrettable fact that the number of accidents associated with the use of ladders is still too high resulting in serious and in some instances fatal injuries. In most if not all instances, the reason for such accidents is inadequate anchoring of the ladder when being in position angled against a wall or similar structure. Many and varied arrangements have been proposed for stabilizing the ladder in its use position. For example, legs attached to the stiles of the ladder have been suggested for additional contact with the ground to give more stability and struts for contact with the supporting wall have also been proposed.

To this end, the safety demands for entering into a pit of an elevator shaft have been intensified as this is to be read in the EN 81-20 regulations. So, the maximum weight of the ladder shall not exceed 15 kg in order to allow its easy and safe handling from the landing sill (some national regulations may even request a maximum weight less than 15 kg for manual handling) and the safe use of the ladder in its position of use shall be ensured by means of a device securing the ladder to the landing sill, or the bottom of the pit, or the wall of the well. At least, the risk of a person tipping over of the ladder when standing or grasping the upper part of the ladder above a landing sill level shall be prevented by means of appropriate measures.

From a technical point of view, it is critical to minimize the impact of these requirements for a layout design of standard elevators. A more specific type of ladder support for ladders intended for a use in pits finds form in a bracket attachable at the ladder with a clamp for positive engagement with for example a wall or landing level of an elevator shaft. In use the ladder is anchored at its top end to the floor edge, thus assisting in the prevention of inadvertent slippage away from the intended orientation of the ladder against the wall of the shaft. One such bracket for a modular ladder with an adjustable sill hook profile is described in EP 1 609 943. A locking device is provided at the sill hook profile being parallel adjustable to a longitudinal axis of the ladder rail being therewith fastened over a support or directly over a pit level.

An additional request would be the ease of installation and use during the installation and maintenance. The future usage of this invention would be all elevators requiring a pit ladder.

AIM OF THE INVENTION

It is therefore a general object of the present invention to provide an improved ladder and a convenient support device which facilitates an attachment of the ladder to a structure against which the ladder is to be placed in a leaning orientation to prevent tipping of the ladder, especially when a person grasps a part of the ladder above a landing sill level, and to find a solution for a convenient placement of such device when the ladder is not in use. The latter shall aim to arrange the ladder parallel to a pit wall so that the ladder can remain in the shaft even when a car is moving in the shaft.

SUMMARY OF THE INVENTION

Basic idea of the invention is thus a provision of a ladder with integrated tipping protection and integrated landing fixing by simultaneously creating a space saving structure when the ladder is not in use. To this end, there is provided a ladder support bracket having a support shoulder for creating a support contact with a complementary structure like the plane of a floor, wherein the bracket further comprising at least one jaw for joining the bracket to an elongated rail of a ladder, the jaw having a retainer mechanism by means of which the bracket can be brought into a clamping position attaching the bracket unmovably to the rail and a resting position holding the bracket in swivel connection relative to the rail and/or movably along at least a section of such rail.

The complementary structure in the simplest case is a horizontal floor surface at the upper edge of a pit. To realize a good support contact the support shoulder advantageously comprises a bearing surface for being put onto said horizontal floor level.

To bring said support shoulder in stable contact with a ladder, the ladder support bracket comprises at least one jaw for joining the bracket to an elongated rail of a ladder, i.e. the one which is upstanding when propping up the ladder. A ladder meant herewith in the application includes two of said upstanding rails which are interconnected by a plurality of rungs.

As the ladder weight is limited according to the regulations—see for example EN 81-20—the inventive concept heeds to not add extra weights to the ladder. The ladder meant by the invention can have a weight of about 5 kg, only. The ladder can show a foldable construction, which minimizes the layout impact of the ladder. The structure of the support bracket permits the fixing to be placed in the correct location between ladder rungs. The design is made to be flexible by being fixable to the correct position for putting the ladder in use by the installation or maintenance crew. The design also prevents the tipping of the ladder by moving the critical point in the structure further away from centre of gravity. When the ladder is to be put into a storage position at the wall site, the fixing structure, namely the support bracket is to be folded down into the ladder plane and thus minimizes the impact of the ladder to layout drawings.

The inventive ladder a) needs less space taken in the pit layouts due to a foldable design of the support bracket into the ladders plane.
b) and prevents the ladder from tipping.
c) and fixes the ladder to the landing according to all code requirements.
d) Further, it is improved over the current ladder fixing design by being more robust.

The upstanding rails may include a rotary joint in order to make the ladder foldable; however this is not a must. Even a plurality of those rotary joints may be present in order to make the ladder foldable in a multiple manner.

Essential for the invention is that said jaw has a retainer mechanism by means of which the support bracket can be brought into at least two positions when having arranged the inventive support bracket at a ladder. The first position concerns a clamping position attaching the bracket unmovably to such a rail. The second position is a resting position holding the bracket in a swivel connection relative to the rail. Optionally, there is also a possible traverse-movement of the bracket along at least a section of the rail. As regards the clamping position in which the bracket is fixed to the ladder a relative position between the ladder and its support bracket is realizable to create a safe placement of the ladder against an object like a pit wall by having placed the inventive bracket conveniently against the pit wall or pit wall edge, meaning for example onto the floor-ground at the upper end of the pit. By propping up the ladder in this way the created support contact of the support shoulder with said complementary structure, i.e. the floor edge eliminates a tipping of the ladder. This means that due to that at least a part of the support shoulder is placed on the horizontal floor level, the ladder can no longer be turned around in that plane corresponding to the wall against which the ladder is propped up. This is especially an advantage when a person is standing or grasping the upper part of the ladder above said floor level since this has been in prior art the most often case of having pushed the ladder to one side when grasping one of the rail-ends.

As regards the resting position of the support brackets, the same is in a swivel connection relative to a ladder's rail. By means of this measure the support bracket can be brought into a resting position for the case the ladder is not in use. The movement for bringing the support bracket from an acting position in which the support shoulder enhances the support of the ladder, into the resting position and vice versa is realized best by means of a swivel turning movement. Pivoting the support bracket between these two positions conveniently takes place about an axis which is parallel to the rungs of the ladder or other said about one being perpendicular to the longitudinal axis of a rail.

By means of the optional shifting movement of the support bracket along at least a distance or section of a rail the relative position between the support bracket and the ladder as such can be adjusted to bring the support bracket into a convenient height in dependency of the pit wall-altitude. Additionally, such a traverse-movement can help to further swivel the bracket down into the ladder's plane formed by the rails. The more the bracket is shifted away from that adjacent rung towards which the bracket is to be swivelled against, the further it can be pivoted into the ladder's plane.

To realize a good contact between the support shoulder and the horizontal floor level, the support shoulder advantageously comprises a bearing surface for being put onto said horizontal level. Further, according to a convenient improvement the bearing surface is at least partially completed with a supporting edge surface which is formed rectangular to the bearing surface. Therewith, the support shoulder is made complementary to the floor edge enhancing stability of the position between ladder and pit wall and floor edge. So, according to the last elucidated embodiment the support shoulder comprises two surfaces which can be exactly laid on a floor edge against which the ladder in question is to be propped in the acting position of the bracket. In this respect, it is convenient to make the bearing surface of the support shoulder which shall be put onto the horizontal floor level bigger than the supporting edge surface which is to be placed against the vertical pit wall. This leads to that according to a convenient embodiment, the resting position of the bracket shall result from a swivel movement of the bracket by positioning the support shoulder with the bigger one of its support surfaces (being in this case said bearing surface) into a plane which corresponds by the two rails of the ladder. Therewith, a space saving structure is realized according to which the support bracket does especially not protrude from the outer circumference of the ladder in the resting position of the bracket.

It is to be noted that it is also possible that the supporting edge surface engages into a groove which is made vertical into the floor section. This enhances a further time the halt of the ladder since then it is even eliminated that the ladder tips back into the pit.

According to a further development of the invention, the retainer mechanism of the support bracket is formed such to encircle or encompass a rail by having further a tensioning bolt acting as an actuator for the clamping position and the resting position, respectively. The used terms "encircle or encompass" do not mean obligatory to that the jaw completely touches the rail in question. Quite to the contrary, it is sufficient to that only a part of the outer surface of a rail is clamped by the jaw. In case a ladder rail is formed by a cuboid block it is sufficient to that the jaw clamps the rail by touching two of parallel block-walls and leaving a free space between the other two parallel block-walls.

The above thoughts lead to a development of the jaw in that sense that the jaw is built in the form of trapeze with pairs of parallel walls encompassing the ladder rail in an abutting manner when being in the resting position. A possible design for this structure can be for example seen in the embodiment outlined in the following drawings.

According to any of the elucidated embodiments it is convenient to provide the ladder bracket with two jaws which are to be mounted to both rails of a ladder, respectively.

Therein,

Figure 1:
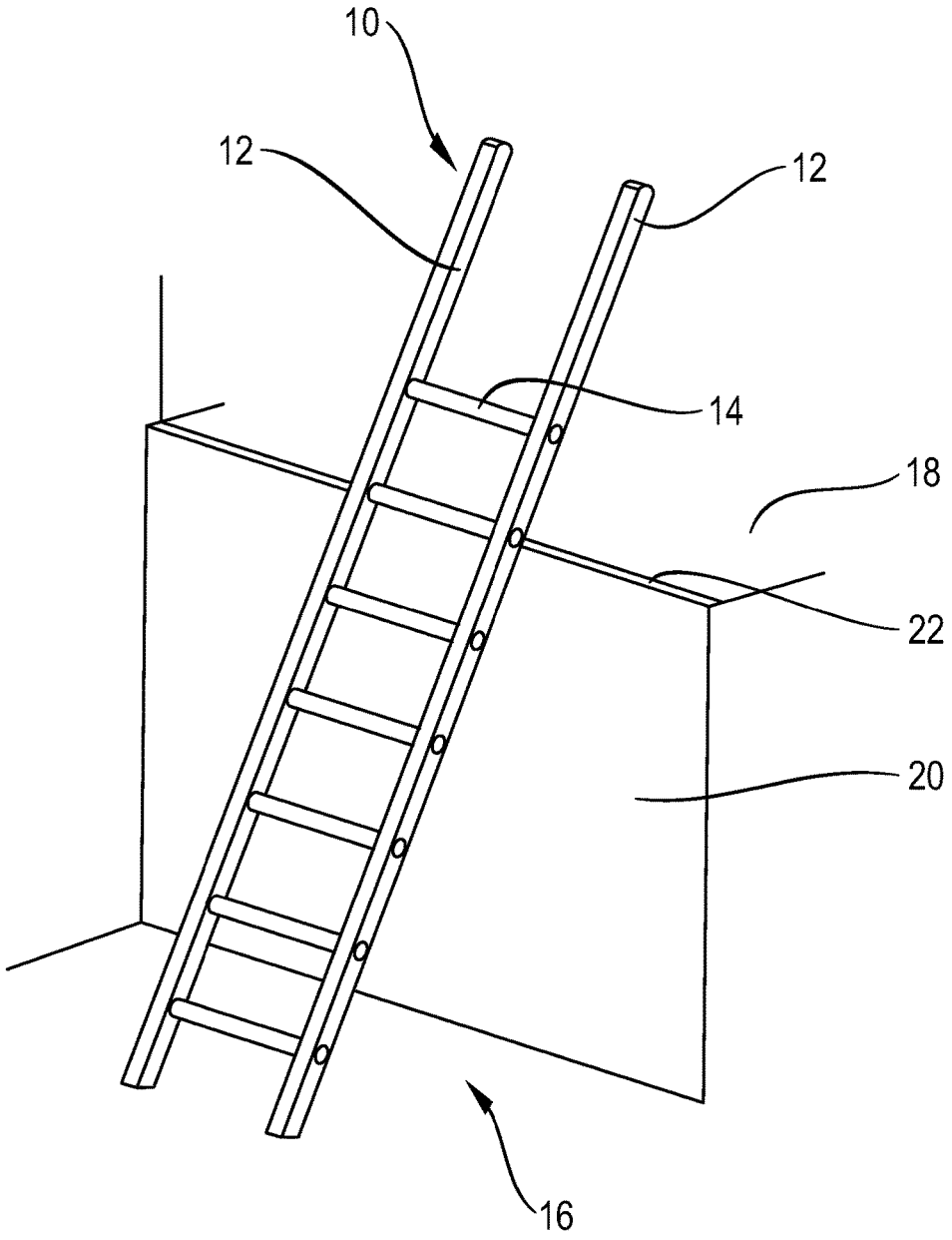
FIG. 1 shows a ladder being propped up in an elevator shaft or pit.

In FIG. 1 a ladder 10 is to be seen being propped up in a pit 16 or the like against a pit wall 20. At the upper end of said wall 20 there is a floor edge 22 placed to the proximate floor level 18. The ladder 10 comprises two elongated rails 12 being in an upright—on nearly upright direction when being in said propped up position. In between said rails 12 there are rungs 14 onto which a person can step on. In this drawing no support bracket is shown.

Figure 2:
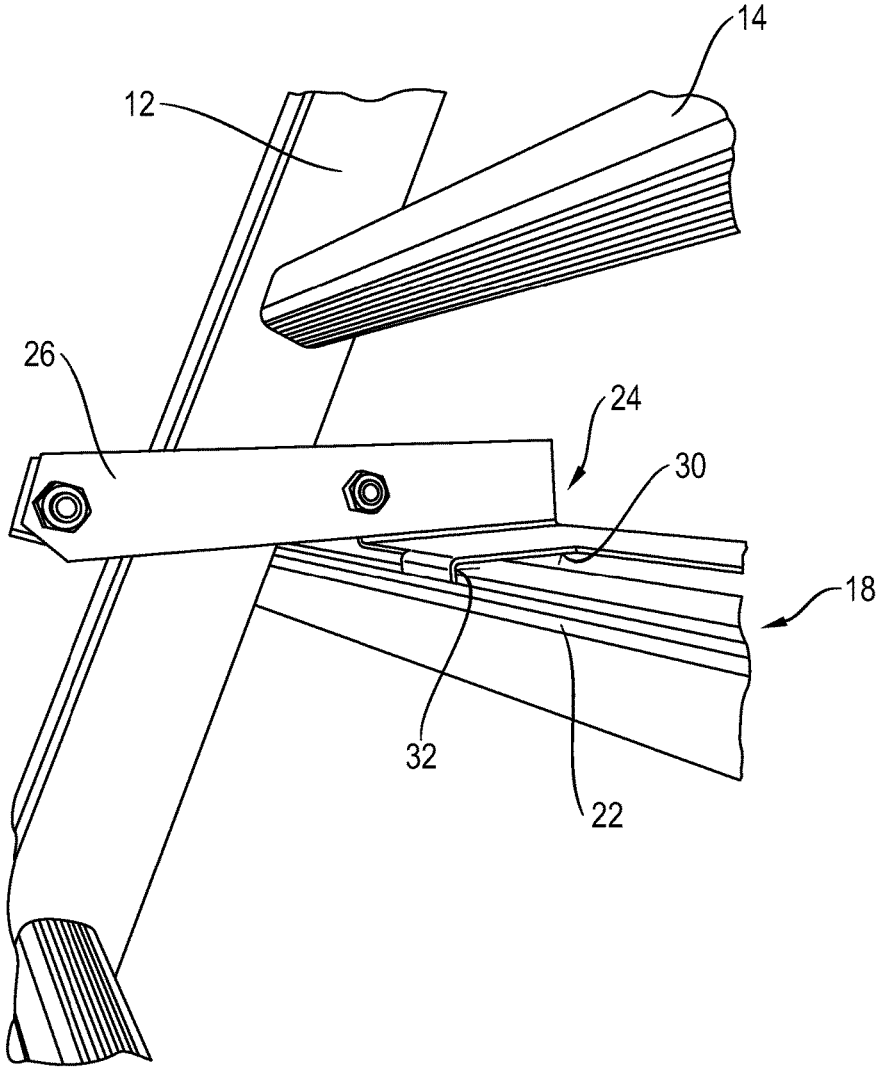
FIG. 2 shows constructive details of an embodiment of the inventive support bracket.

FIG. 2 now shows the inventive ladder support bracket being mounted on the left hand side rail 12 between two rungs 14. The support bracket comprises a support shoulder 24 having a bearing surface 30 being laid down on the floor level 18 by means of which the ladder is fixed securely against sideways. As this is to be seen, the floor edge has a recess in the horizontal floor level into which the supporting edge surface 32 of the bracket can be placed in for enhancing said the fixation. In doing so, the ladder is also secured against tipping backwards into the pit.

Figure 3:
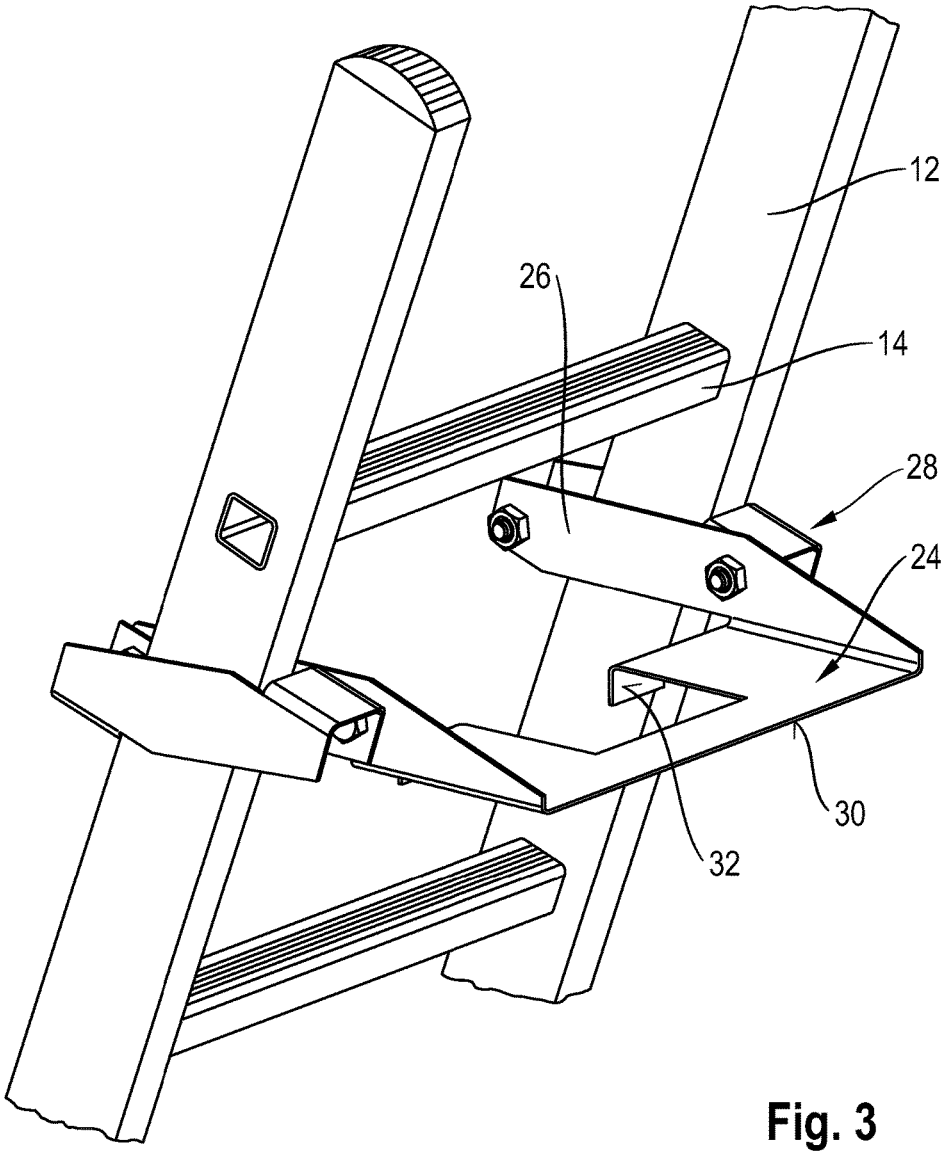
FIG. 3 shows the inventive idea in a convenient embodiment.

FIG. 3 now shows the ladder support bracket by omitting details of the pit. The shown jaws 26 are parallelograms, respectively, forming a retainer mechanism by jamming the jaws 26 to the rails 12, respectively. The retainer mechanisms concern the parts of the bracket through which the ladder rails pass, formed by an inner side that is an extension of the support shoulder and an outer side, the sides being attached together by two bolts and nuts such that the ladder rail is held loosely between the opposing inner and outer side of the mechanism and the opposing bolts—even when the bolts are tightened. In normal use, the bracket can be moved up and down at any time and further swivelled so that the support shoulder 24 can be pivoted towards that plane being built by the two rails 12 of the ladder.

Figure 4:
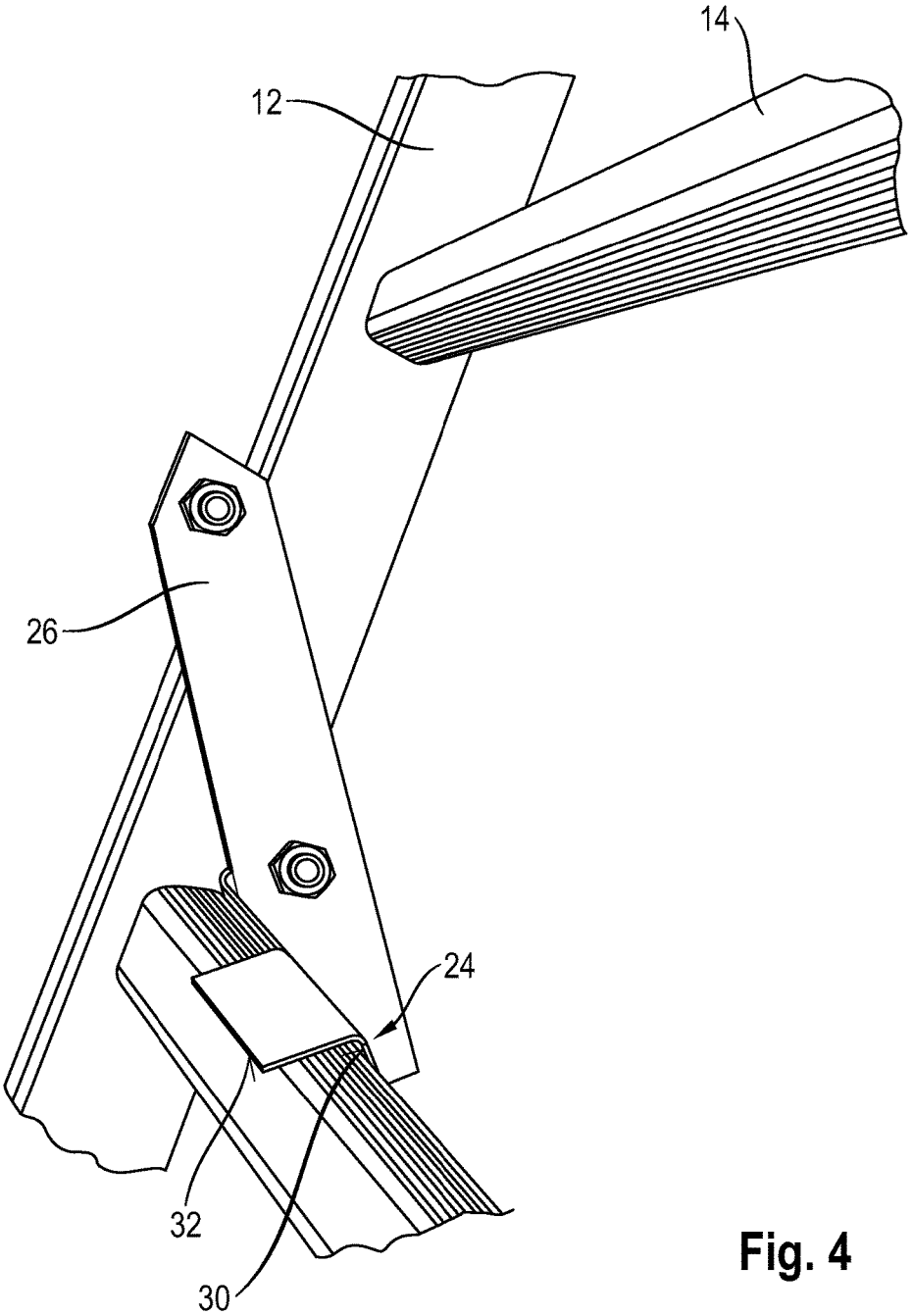
FIG. 4 shows Details of an inventive bracket in hinged position.

Such a swivelled position is shown in FIG. 4. It is to be noted that in case the whole bracket is moved a bit more up until the jaws 26 reach the upper rung 14, the bearing surface 30 could be even more pivoted into the plane formed by the two rails 12 of the ladder. The jaw is formed by the two opposing edges of the retainer mechanism, adjacent to the narrow sides of the rail profile.

Due to the clamping position the load on the ladder is partly supported by the support shoulder. Thereby it tilts the rails relative to the retaining mechanisms such that the jaws grip the rails, leading to a securing the ladder from tipping. For the resting position in turn, namely when the ladder is lifted up from the landing sill, the support bracket drops freely and can be tucked to the resting position for minimal footprint when stored on the shaft wall.

All features shown or discussed with respect to particular embodiments of the invention can be combined in various applicable combinations in order to realize their positive technical effects simultaneously.

The scope of the present invention is given by the claims only and is not restricted by the exemplary embodiments discussed in the description or depicted in the figures.

REFERENCE NUMERALS

10 ladder
12 rail of ladder
14 rung of ladder
16 pit
18 floor level
20 pit wall
22 floor edge
24 support shoulder
26 jaw
28 retainer mechanism
30 bearing surface
32 supporting edge surface

The invention claimed is:

1. A ladder support bracket, comprising:

a support shoulder for creating a support contact with a complementary structure; and at least one jaw for joining the bracket to an upstanding rail of a ladder, wherein the at least one jaw, when being attached to the upstanding rail of the ladder, can be brought into a clamping position attaching the bracket unmovably to the upstanding rail and a resting position where the bracket is held in a swivel connection relative to the upstanding rail and the bracket is movable along at least a section of the upstanding rail, and wherein the resting position of the bracket results from the swivel movement of the bracket by resting the support shoulder against a nearest ladder rung below the bracket.

2. The ladder support bracket according to claim 1, wherein the resting position of the bracket results from the swivel movement of the bracket by positioning the support shoulder with a bigger one of support surfaces of the support shoulder thereof into a plane being formed by two rails of the ladder.

3. The ladder support bracket according to claim 1, wherein the at least one jaw is formed such to encircle or encompass the upstanding rail by a force of which is biased by a tensioning bolt.

4. The ladder support bracket according to claim 1, wherein the jaw is in the form of a trapeze with pairs of parallel walls encompassing a ladder rail in an abutting manner.

5. A ladder having a comprising the support bracket according to claim 1.

6. The ladder support bracket according to claim 1, wherein the swivel connection of the bracket is realized by enabling the swivel movement of the bracket in an axis perpendicular to a longitudinal axis of the upstanding rail.

7. The ladder support bracket according to claim 6, wherein the support shoulder comprises a bearing surface for being put onto a horizontal level.

8. The ladder support bracket according to claim 6, wherein the resting position of the bracket results from the swivel movement of the bracket by positioning the support shoulder with a bigger one of support surfaces of the support shoulder thereof into a plane being formed by two rails of the ladder.

9. The ladder support bracket according to claim 6, wherein the resting position of the bracket results from the swivel movement of the bracket by resting the support shoulder against a nearest ladder rung below the bracket.

10. The ladder support bracket according to claim 6, wherein the at least one jaw is formed such to encircle or encompass the upstanding rail by a force of which is biased by a tensioning bolt.

11. The ladder support bracket according to claim 1, wherein the support shoulder comprises a bearing surface for being put onto a horizontal level.

12. The ladder support bracket according to claim 11, wherein the resting position of the bracket results from the swivel movement of the bracket by positioning the support shoulder with a bigger one of support surfaces of the support shoulder thereof into a plane being formed by two rails of the ladder.

13. The ladder support bracket according to claim 11, wherein the resting position of the bracket results from the swivel movement of the bracket by resting the support shoulder against a nearest ladder rung below the bracket.

14. The ladder support bracket according to claim 11, wherein the at least one jaw is formed such to encircle or encompass the upstanding rail by a force of which is biased by a tensioning bolt.

15. The ladder support bracket according to claim 1, wherein the bearing surface is at least partially completed with a supporting edge surface formed rectangular to the bearing surface, the support shoulder being made therewith complementary to a floor edge.

16. The ladder support bracket according to claim 15, wherein the resting position of the bracket results from the swivel movement of the bracket by positioning the support shoulder with a bigger one of support surfaces of the support shoulder thereof into a plane being formed by two rails of the ladder.

17. The ladder support bracket according to claim 15, wherein the resting position of the bracket results from the swivel movement of the bracket by resting the support shoulder against a nearest ladder rung below the bracket.

18. The ladder support bracket according to claim 15, wherein the at least one jaw is formed such to encircle or encompass the upstanding rail by a force of which is biased by a tensioning bolt.

* * * * *